US005127558A

United States Patent [19]

Paolo

[11] Patent Number: 5,127,558

[45] Date of Patent: Jul. 7, 1992

[54] METHOD AND DEVICE FOR TURNING OUT MEN'S STOCKINGS OUTSIDE THE RELEVANT OPERATING MACHINE

[76] Inventor: Conti Paolo, Via Neri di Bicci 14, Florence, Italy

[21] Appl. No.: 605,927

[22] Filed: Oct. 30, 1990

[30] Foreign Application Priority Data

Nov. 3, 1989 [IT] Italy ..... 9560 A/89

[51] Int. Cl.[5] ..... A41H 43/00

[52] U.S. Cl. ..... 223/40; 223/39; 223/42; 66/147

[58] Field of Search ..... 223/43, 41, 39, 38, 223/40, 42; 66/149 R, 147

[56] References Cited

U.S. PATENT DOCUMENTS

| | | | |
|---|---|---|---|
| 2,657,841 | 11/1953 | Landucci et al. | 223/40 |
| 2,999,618 | 9/1961 | Smith | 223/43 |
| 3,455,124 | 7/1969 | Rossler | 66/147 |
| 3,941,285 | 3/1976 | Bailey | 223/43 |
| 3,949,913 | 4/1976 | Smith et al. | 223/43 |
| 4,281,781 | 8/1981 | Pope | 223/43 X |
| 4,381,068 | 4/1983 | Raisin et al. | 223/43 X |
| 4,509,666 | 4/1985 | Rosso | 223/42 X |
| 4,665,720 | 5/1987 | Beconcini et al. | 66/149 R X |

FOREIGN PATENT DOCUMENTS

| | | | |
|---|---|---|---|
| 243948 | 3/1987 | Fed. Rep. of Germany | 223/39 |
| 1234482 | 5/1986 | U.S.S.R. | 223/39 |
| 2029470 | 3/1980 | United Kingdom | 223/39 |
| 2057527 | 4/1981 | United Kingdom | 223/39 |
| 2103257 | 3/1983 | United Kingdom | 223/41 |

*Primary Examiner*—Werner H. Schroeder
*Assistant Examiner*—Bibhu Mohanty
*Attorney, Agent, or Firm*—McGlew & Tuttle

[57] ABSTRACT

To turn out men's stockings, that is to say socks, outside and at a distance from the relevant operating machine, such as a circular machine for sock manufacture or a toe-sewing machine, use is made of:

a device from extracting the sock 3 from the machine 1 by sucking it into a pipe 2 which conveys it to a turning-out station 4 positioned at a distance from the machine 1 and, after turning out, for directing it to the discharge;

a turning out station 4 comprising: a chamber 40 having a vertical axis, with an articulated grilled diaphragm 41 for intercepting and positioning the sock 3 vertically and with the cuff 30 at the top; pincers for grasping the cuff 30 from the outside and extending it into a circle; a cup 52 for clamping the cuff 30 thus extended; a turning out tube 5 which is coaxial with the chamber 40, passes into said cup 52 and into the port 43 of said diaphragm 41 and is subject to the double-action pneumatic cylinder 9, in line with the chamber 40, in which tube 5 the sock 3 comes to be accommodated partly hanging, in such a manner that the travel of the tube 5 towards the top causes the actuation of the cup 52, the opening of the diaphragm 41 and the turning out on itself of the sock 3 from the cuff to the toe, passing it through the port (43) of the diaphragm 41;

a bell 7 for expulsion of the sock 3 which has been turned out and has the toe in front.

16 Claims, 8 Drawing Sheets

METHOD AND DEVICE FOR TURNING OUT MEN'S STOCKINGS OUTSIDE THE RELEVANT OPERATING MACHINE

FIELD OF THE INVENTION

The present invention relates in general to a method and a device for everting a flexible tube and more particularly for turning out men's stockings at a location away from a relevant operating machine.

BACKGROUND OF THE INVENTION

It is known that, at the end of a production using a circular knitting machine, men's stockings, henceforward called "socks", have to be turned out in order to permit further finishing operations such as, for example, the invisible sewing of the toe.

It is also known that after the sewing of the toe, the socks have to be turned out again in order to be turned right side out.

At present, the turning out operation is performed by means of a turning out device only found in circular knitting machines for sock manufacture. The turning out device is fixed coaxially with the cylinder of the needles, and the turning out is carried out by pneumatic means.

However, this known device has some serious disadvantages. A first disadvantage resides in the fact that it is mounted inside the circular machine so that it requires different adaptation in relation to the type of machine for which it is intended. A further disadvantage is due to the pneumatic functioning which has limited reliability owing partly to the characteristic rigidity of the socks and partly to the impurities which are inevitably sucked in by the machine and which compel it to be stopped at a certain frequency, thus reducing the rate of production.

As far as the turning out of the socks after the sewing of the toe is concerned, the socks still must be turned out by hand.

SUMMARY AND OBJECTS OF THE INVENTION

It is an object of the invention to eliminate the above disadvantages. This object has been achieved according to the invention by adopting an operational method which comprises, in succession, the following stages:

sucking the flexible tube or sock from the relevant operating machine and conveying it outside and at a distance from the latter, oriented with the cuff in front;

stopping the sock thus conveyed against a grilled diaphragm. The amount of suction is carefully controlled and acts in an upward direction to offset the force of gravity on the sock. The suction force on the sock against the grilled diaphragm is carefully balanced against the force of gravity on the sock to cause the sock to be positioned vertically with the cuff turned upwards;

grasping the first end of the flexible tube or the outside of the cuff of the sock thus positioned at a number of points, and applying at said points a traction in a radial horizontal direction so as to extend the cuff into a circle;

clamping from the outside the cuff thus opened into a circle;

everting the sock on itself by passing it through the cuff thus opened and clamped by proceeding from the cuff towards the toe;

freeing the cuff of the sock thus turned out and discharging the sock, oriented with the toe in front.

To implement said method, it is envisaged to use:

means for extracting the sock from the relevant operating machine by sucking it into a pipe which conveys it to a turning-out station positioned at a distance away from the machine and, after turning it out, directing it to a discharge bell;

a turning out station comprising: a chamber having a vertical axis, with an internal articulated grilled diaphragm for intercepting an positioning the sock vertically and with the cuff at the top. The grilled diaphragm allows air to pass through the chamber and exert a force on the sock. However, the sock cannot pass through the grilled diaphragm and is therefore held against the diaphragm by the force of the moving air. The force of the moving air does not fully counteract the force of gravity on the sock and the effect of the pipe that conveyed the sock to the chamber. All of these factors are properly balanced so as to have the sock hang vertically in the chamber. Also in the chamber are means for grasping the cuff from the outside. The grasping means apply radial traction to bring about its opening into a circle. Clamping means external to the sock and subject to a vertical force towards the top to clamp the entire cuff against the seat of the diaphragm. A turning out tube or pipe coaxial with the chamber passes into the cup and into the port of the diaphragm in which the sock is accommodated. The tube is subject to a vertical reciprocating movement, the travel of which towards the top, with the diaphragm open, causes the turning out on itself of the sock, from the cuff to the toe, and its simultaneous passage through the port of the diaphragm;

a bell for expulsion of the sock which has been turned out and has the toe in front.

Advantageously, the extending means for grasping and extending the cuff of the sock is constituted by a number of complanate pairs of pincers which are distributed around the chamber, and which are angularly equidistant and horizontally mobile in a radial direction under pneumatic control.

The clamping means for guaranteeing the clamping of the cuff of the sock in the open-circular state are advantageously constituted by a cup, mounted slidingly on the turning-out tube and stressed elastically against the head of the latter.

The advantages obtained by virtue of the present invention consists essentially in that the turning out of the sock is performed outside and at a distance away from the relevant operating machine, whether it is a circular knitting machine for sock manufacture, or toe sewing, and thus without interfering with its functioning. The turning out itself is brought about entirely by mechanical means acting axially on the entire periphery of the sock and progressively on each corresponding row of stitches. It is possible to achieve correct and reliable turning out and moreover in a shorter time than that necessary for the production of a sock by a circular machine, so that a number of circular machines can be served by a single turning-out device.

These and other advantages and characteristics of the invention will be understood to a greater extent and more clearly by anyone skilled in the art from the description which follows and with the aid of the attached drawings which are given by way of practical exemplification of the invention but are not to be considered as limitative.

DETAILED DESCRIPTION OF THE PREFERRED EMBODIMENT

More specifically, and with reference to FIGS. 3 through 8 of the attached drawings the method for turning out men's stockings according to the invention comprises the following operations:

(a) sucking the sock, which has been made and detached from the circular knitting machine and conveying the sock into a turning-out station positioned outside and at a distance away from the circular knitting machine;

(b) stopping the sock in the turning-out station, in a vertical position and with the cuff at the top;

(c) grasping the cuff thus positioned, at a number of points, which are angularly equidistant, and applying at these points a radial traction so as to bring about the extending or pulling apart, that is to say the circular opening of the cuff;

(d) clamping from the outside, the cuff thus opened in a circle, along its entire circumference;

(e) turning the sock on itself by passing it through the cuff thus opened, proceeding from the cuff toward the toe;

(f) freeing the cuff of the sock thus turned out and conveying the sock, oriented with the toe in front, into a discharge chamber.

Figure 1:
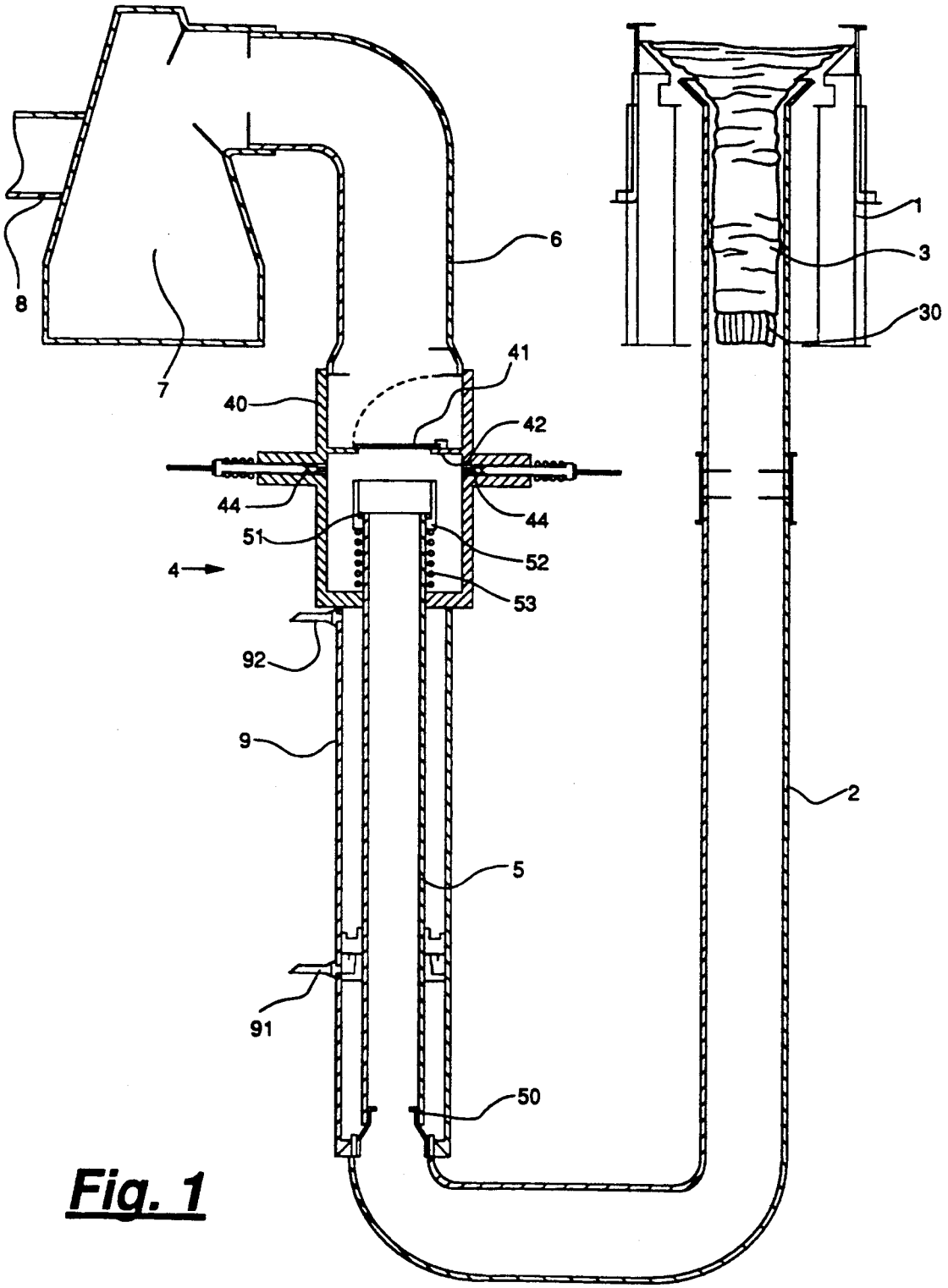
FIG. 1 is an overall view in vertical cross-section of a turning out device for socks according to the invention, serving a circular machine for sock manufacture and with the sock under formation.
Figure 2:
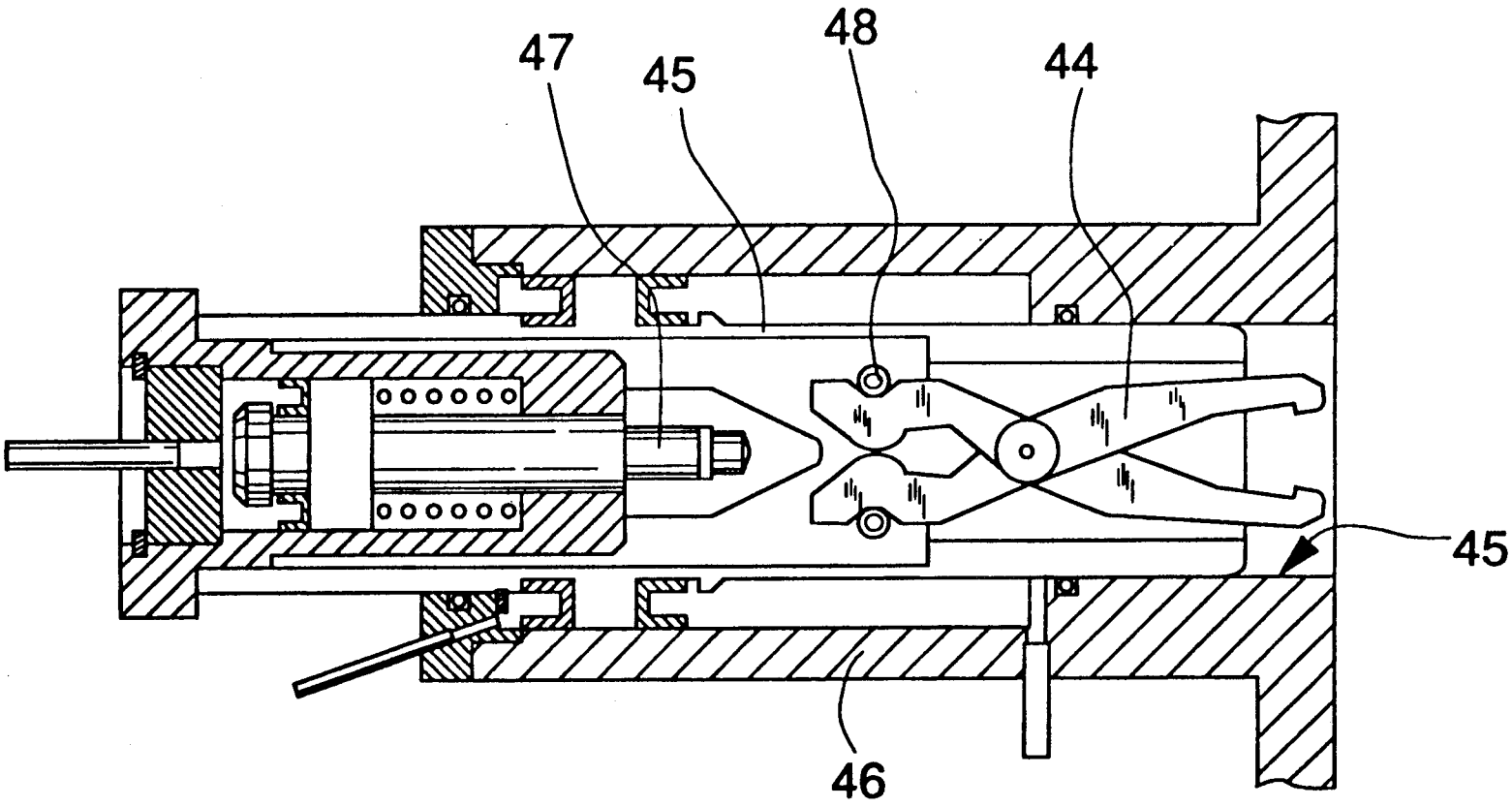
FIG. 2 represents the detail of one of the pairs of pincers of the device in FIG. 1 for opening in a circle the cuff of the sock in a turning-out station.

According to a preferred embodiment, a device for turning out men's stockings away from the relevant operating machine according to the above method, according to the invention and with reference to FIGS. 1 and 2 in the attached drawings, comprises:

a pipe 2, which is rigidly connected to the exit of the machine 1, for the collection of the sock 3 after it has been detached from the machine, and for conveying it pneumatically, with the interposition of a mobile tube or pipe 5, to a turning-out station 4 which is connected, downstream, to a pneumatic suction pipe 8 with the interposition of a connecting pipe 6 and of an expulsion bell 7;

a turning-out station 4 with a cylindrical chamber 40 having a vertical axis, connected at the top to said connecting pipe 6 and at the bottom to an operating cylinder 9.

Figure 3:
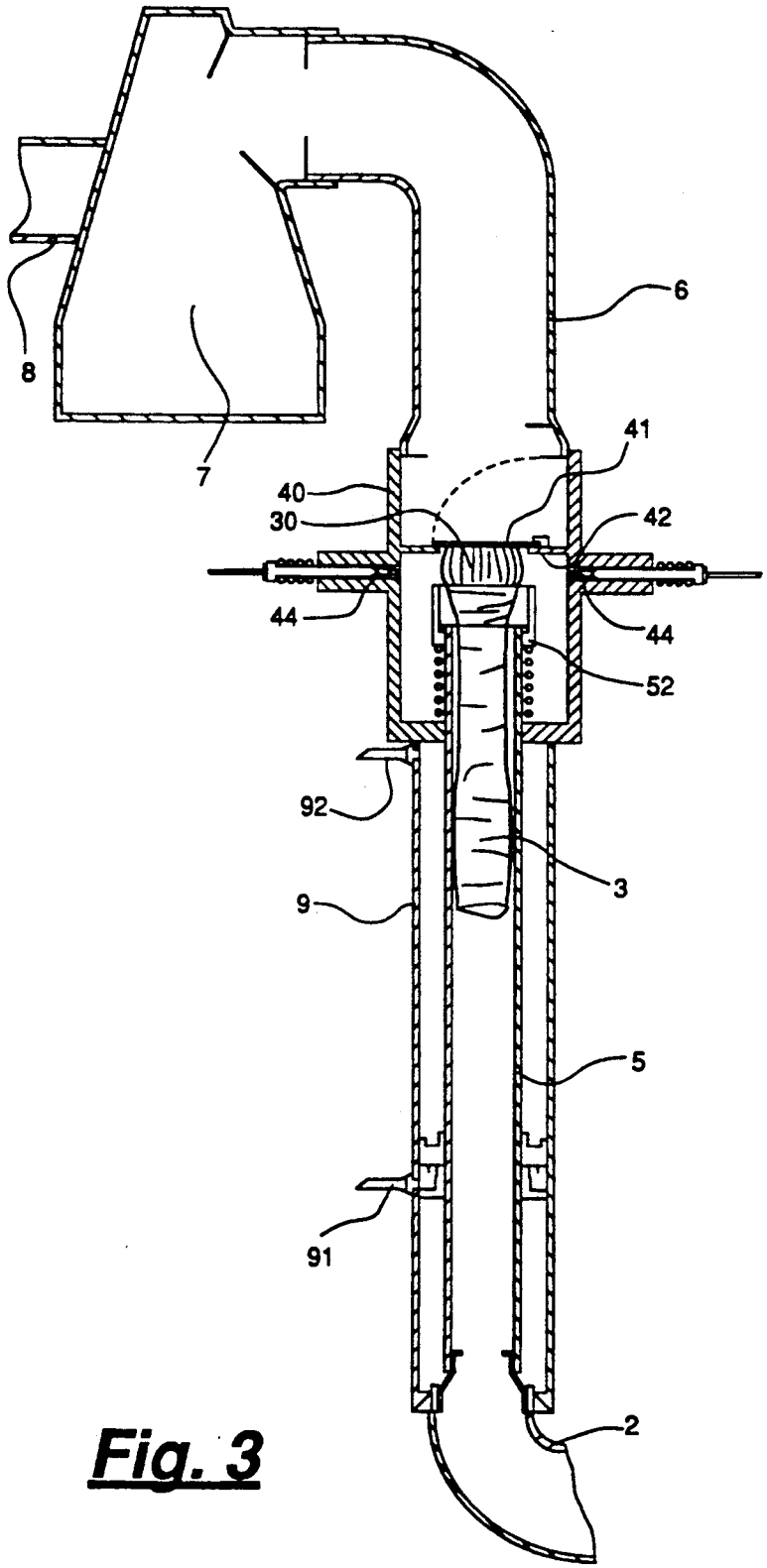
FIGS. 3 through 8 represent the various stages of the turning out of the sock with the device as shown in FIG. 1.
Figure 4:
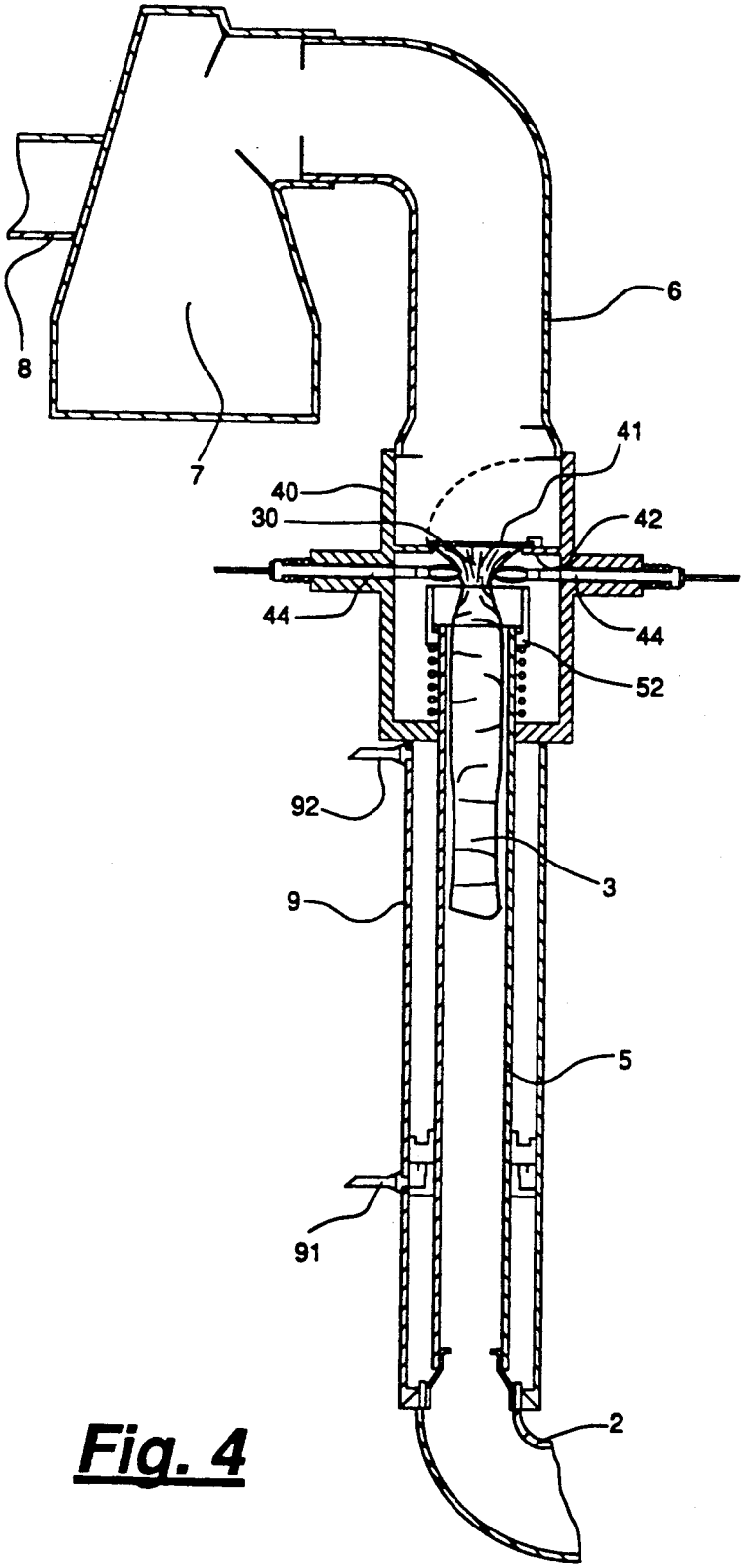
Figure 5:
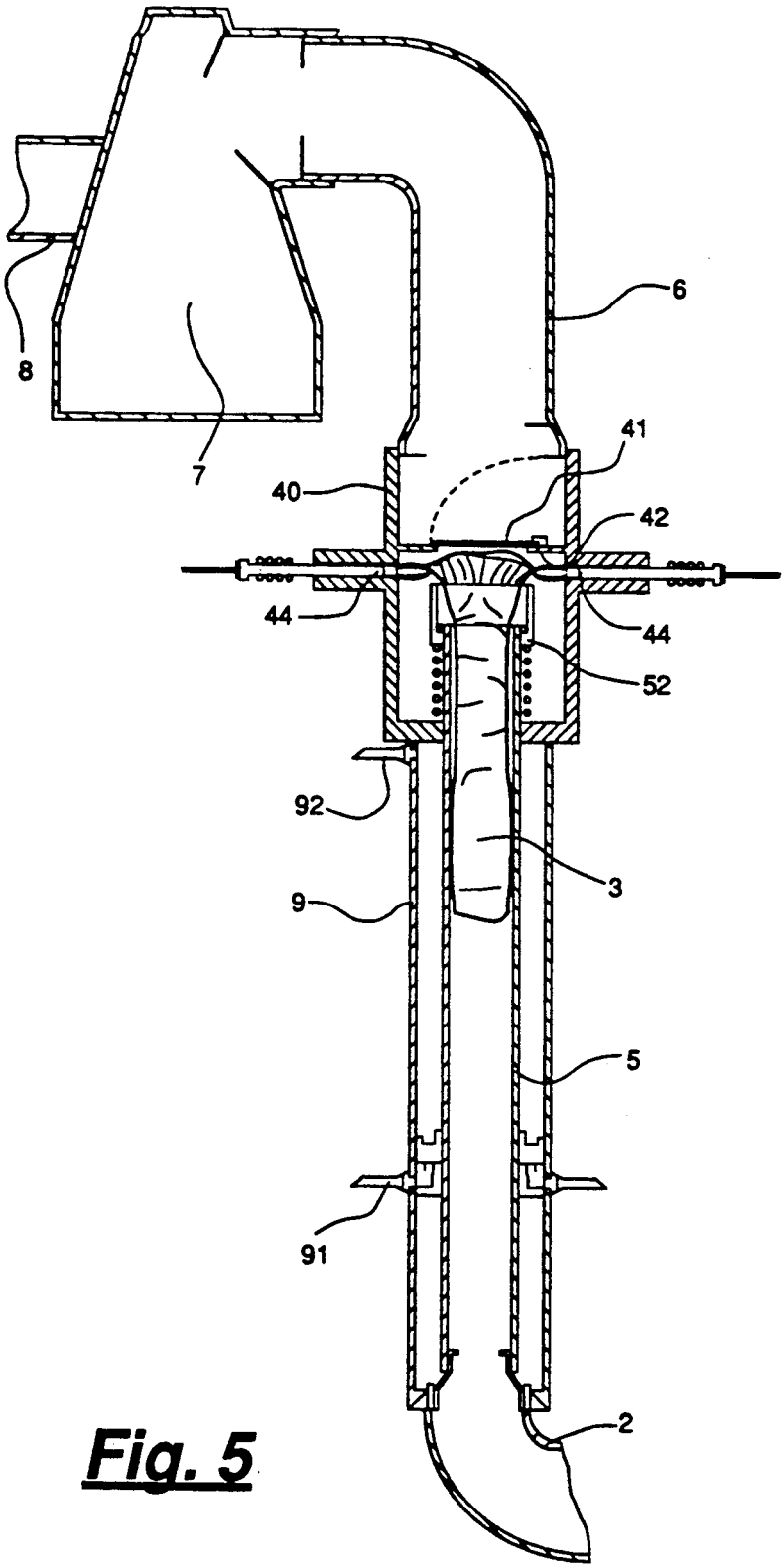
Figure 6:
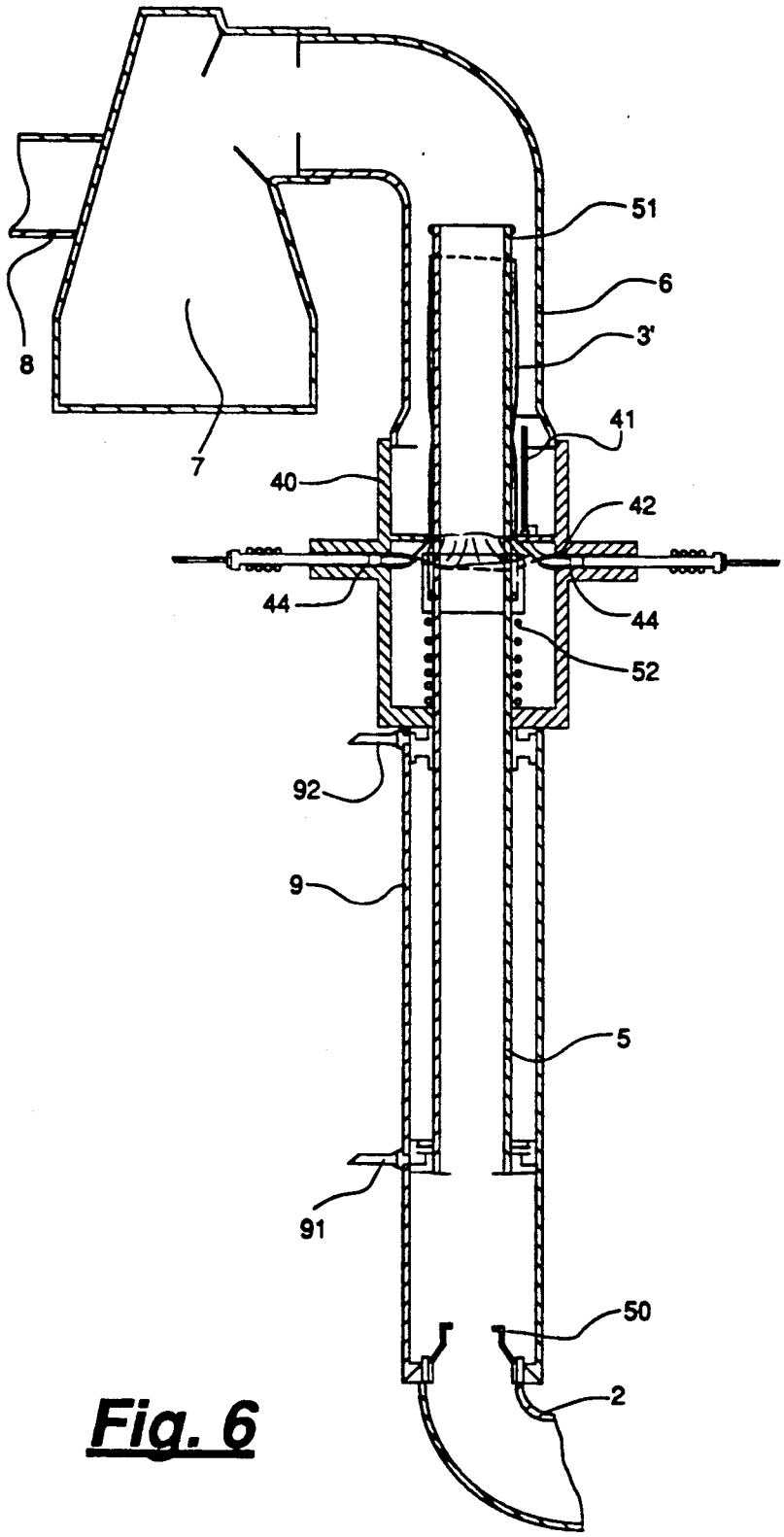
Figure 7:
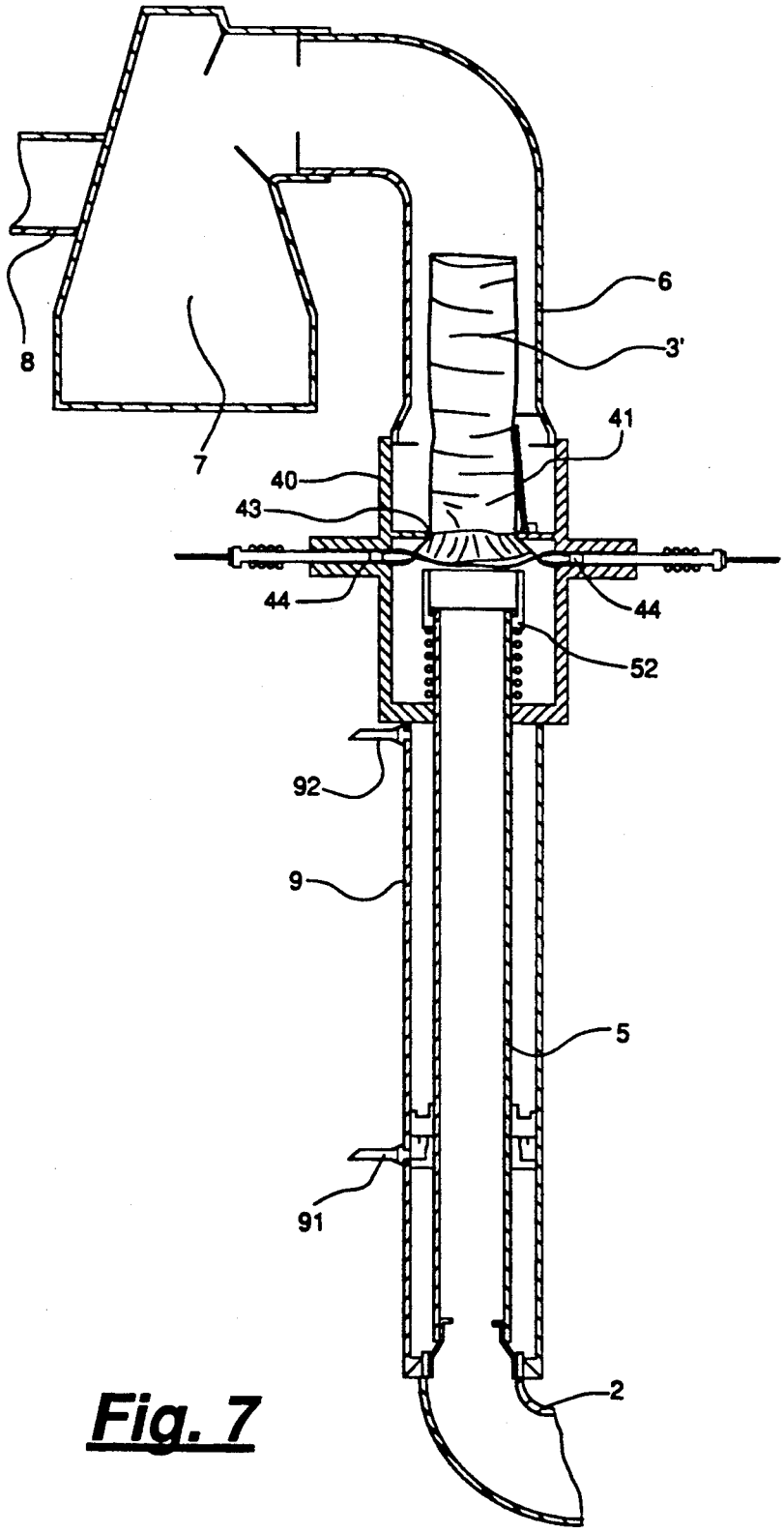
Figure 8:
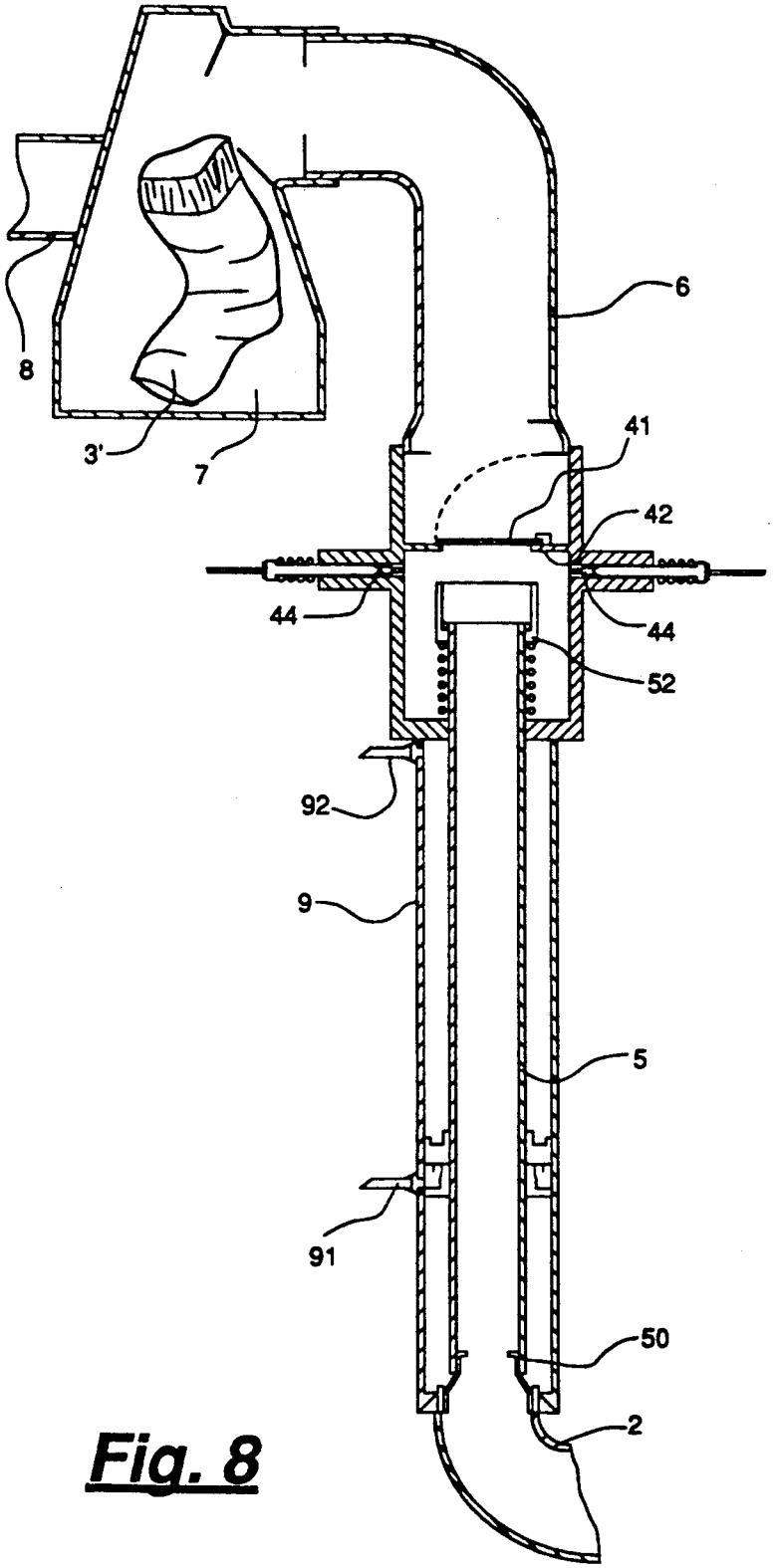

Inside said chamber 40, there is a grilled diaphragm 41 which is articulated at its seat 42 defining a circular port 43. The grilled diaphragm 41 is provided with a spring for retention in a horizontal position, that is to close the port 43. The diaphragm is intended to intercept the sock 3, which has been sucked into the chamber 40, stopping it in the vertical stage, with the cuff 30 at the top. The grilled diaphragm 41 can be a porous screen such as a grill or other suitable latticework. A spring constrains the screen 41 horizontal on its seat 42 (a circular bracket). The screen 41 can rotate 90 degrees on the axis A—A from the horizontal position shown in FIGS. 1, 3 through 5 and 8, to a vertical position as shown in FIGS. 6 and 7. The sock is held in the chamber by a combination of forces. The force from the suction source forces the cuff of the sock against the grilled diaphragm. Gravity and the tube or pipe 5 position the lower part of the sock below the cuff, thus causing the sock to hang in a vertical position, as shown in FIG. 3.

Outside the chamber 40 and at a slightly lower height than the diaphragm 41, a number of pairs of pincers 44 (for example four or six) are provided, which are slidable in corresponding horizontal seats 45 which are arranged radially and in an angularly equidistant manner around the chamber and communicate with the chamber in order to make it possible, at the end of the radial travel of the pairs of pincers, to grasp and extend open in a circle respectively the cuff of the sock which is present in the chamber 40.

According to the invention, each of said pairs of pincers 44 is mounted on the mobile member 45 of a double-action pneumatic cylinder 46 and is subject to a pulling-apart element 47 which is mounted on said member 45 at the tail-end of the pair of pincers 44 and the advance of which, under pneumatic control, determines their closing, while an annular spring 48—with the pulling-apart device 47 retracted—determined their opening.

The base of said chamber 40 is provided with a circular axial opening in order to permit the passage of aforesaid tube or pipe 5 which constitutes the mobile member of a double-action pneumatic cylinder 9 which is aligned with the chamber 40 in such a manner that it can assume two positions, one lowered, in which the foot 50 runs over the exit of the pipe 2 and the head 51 emerges into the chamber 40 at a lower height than the pairs of pincers 44 (see FIG. 1). The other position is raised, in which the head 51 of the tube 5 passes into the port 43 of the diaphragm 41 until it reaches the connecting pipe 6 (see FIG. 6).

The tube 5 has the function of a turning-out device for the sock 3 which is in the chamber 40. In the lowered position of tube 5, the sock 3 comes to be accommodated partly hanging on its interior and after the cuff 30 has been opened round by the pairs of pincers 44 and expediently held thus. The head 51 of the tube 5 is capable, as it rises, of progressively turning out the sock toward the top by making it pass through the open cuff 30. For the purpose of holding the cuff 30 still during the turning out of the sock, it is envisaged according to the invention to mount on the upper end of the tube 5 an annular cup-shaped element 52 which is restrained by means of its base by the flanged head 51 of the tube 5 and is pushed towards the top by a cylindrical spiral spring 53 underneath which is mounted on the tube itself 5.

According to the invention, it is envisaged that the pipe 2 can convey singularly to the chamber 40 the socks 3 produced by a number of circular knitting machines 1. The functioning is as follows:

The sock 3, once finished and detached from the circular knitting machine 1, is sucked into the pipe 2 and conveyed into the chamber 40 where the diaphragm 41, which is lowered, stops the sock in a vertical position with the cuff 30 at the top (see FIG. 3); after this, the pairs of pincers 44, which are preferably closed, are pushed fully into the chamber 40 and subsequently opened in such a manner that they receive the cuff 30 at as many points (see FIG. 4); the pair of pincers 44 are then closed and retracted so as to pull apart, that is to say, open the cuff 30 into a circle (see FIG. 5). At this moments, by activating the cylinder 9 through the inlet 91, the turning-out tube rises and, after the cup 52, under the pressure of the spring 53, has clamped the cuff 30 against the seat 42 around the diaphragm 41, the flanged head 51 of the tube 5, continuing in its travel towards the top, raises the diaphragm 41 and pulls the sock 3 upwards, turning it out (see FIG. 6). When turning out is completed, by activating the cylinder 9 through the inlet 92, the tube 5, which lowers the cup 52 again as is descends (see FIG. 7), is retracted. Finally, when the pairs of pincers 44 have been opened, the turned out sock 3 is freed and sucked into the expulsion bell 7 and the diaphragm 41 is lowered again spontaneously, closing the port 43 (see FIG. 8).

In practice, however, the embodiment details can vary in equivalent manner in form, dimensions, arrangement of the elements and nature of the materials used, without moreover departing from the scope of the idea for solution adopted and therefore remaining within the limits of the protection accorded by the present patent of industrial invention.

I claim:

1. A method for everting a flexible tube, the method comprising:

transporting the flexible tube by a fluid through a pipe;

stopping a first end of the flexible tube against a grille diaphragm;

extending the first end of the flexible tube outwardly;

clamping the first end of the flexible tube to a seat around said grilled diaphragm;

removing said grilled diaphragm from said seat; and forcing a remainder of the flexible tube through the extending first end of the flexible tube, thereby everting the flexible tube.

2. A method in accordance with claim 1, wherein:

the first end of the flexible tube is extended outwardly to a size larger than a diameter of said pipe; and the remainder of the flexible tube is forced through the extended first end of the flexible tube by moving said pipe through said seat.

3. A method in accordance with claim 2, wherein:

said grilled diaphragm is removed from said seat by said moving of said pipe through said seat.

4. A method in accordance with claim 1, wherein:

said extending outwardly of the first end of the flexible tube is performed by grasping inwardly onto an outer circumference of the first end of the flexible tube and pulling the first end of the flexible tube radially outward.

5. A method in accordance with claim 1, further comprising:

transporting a plurality of flexible tubes singularly through said pipe at a sufficient delay causing each of the flexible tubes to be separately everted.

6. An apparatus for everting a flexible tube, the apparatus comprising:

a pipe for transporting the flexible tube;

a chamber connected to an end of said pipe and receiving the transported flexible tube;

a grilled diaphragm extending radially across said chamber;

extending means on said chamber for extending a first end of the flexible tube;

clamping means for clamping the extended first end of the flexible tube to said chamber; and forcing means for removing said grilled diaphragm from said chamber and for forcing a remaining portion of the flexible tube through the extended and clamped first end of the flexible tube, thereby everting the flexible tube.

7. An apparatus in accordance with claim 6, wherein:

the flexible tube is transported in said pipe by a fluid flowing means for flowing a fluid through said pipe.

8. An apparatus in accordance with claim 6, wherein:

said clamping means has a seat around said grilled diaphragm and a cup surrounding said pipe, said cup moveable in an axial direction against said seat; and said extending means, extending the first end of the flexible tube between said seat and said cup.

9. An apparatus in accordance with claim 6, wherein:

said forcing means has operating cylinder means for moving said pipe and the remaining portion of the flexible tube through the extended first end of the flexible tube.

10. An apparatus in accordance with claim 9, wherein:

said operating cylinder also moves said grilled diaphragm.

11. An apparatus in accordance with claim 8, wherein:

said cup is biased against said seat and said pipe has a flange means for moving said cup away from said seat.

12. An apparatus in accordance with claim 8, wherein:

said forcing means has operating cylinder means for moving said pipe and the remaining portion of the flexible tube through the extended first end of the flexible tube, said pipe also moving through said seat.

13. An apparatus in accordance with claim 12, wherein:

said grilled diaphragm is biased against said seat and moved away from said seat by said moving of said pipe through said seat.

14. An apparatus in accordance with claim 6, wherein:

said extending means has pincer means for inwardly grasping an outer circumference of the first end of the flexible tube and pulling the first end of the flexible tube radially outward.

15. An apparatus in accordance with claim 14, wherein:

said pincer means is arranged radially around said chamber and is slidably mounted on a double-action pneumatic cylinder.

16. An apparatus in accordance with claim 15, wherein:

said pincer means has an annular spring biasing said pincer means in an open position.

* * * * *